United States Patent [19]

Feuz

[11] Patent Number: 4,633,783

[45] Date of Patent: Jan. 6, 1987

[54] DEVICE FOR CLAMPING AND SUPPORTING A TRANSPORT APPARATUS ON A CONVEYING CABLE

[75] Inventor: Fritz Feuz, Thun, Switzerland

[73] Assignee: Von Roll Habegger AG., Berne, Switzerland

[21] Appl. No.: 752,338

[22] PCT Filed: Oct. 26, 1984

[86] PCT No.: PCT/CH84/00172

§ 371 Date: Jun. 24, 1985

§ 102(e) Date: Jun. 24, 1985

[87] PCT Pub. No.: WO85/01922

PCT Pub. Date: May 9, 1985

[30] Foreign Application Priority Data

Oct. 28, 1983 [CH] Switzerland ..... 5858/83

[51] Int. Cl.[4] ..... B61B 12/12

[52] U.S. Cl. ..... 104/211; 104/209; 104/216

[58] Field of Search ..... 104/202, 204, 208, 209, 104/211, 214, 216–220, 240, 205, 206

[56] References Cited

U.S. PATENT DOCUMENTS

| | | | |
|---|---|---|---|
| 3,416,462 | 12/1968 | Pomagalski | 104/202 |
| 3,610,164 | 10/1971 | Feuz | 104/204 |
| 3,850,110 | 11/1974 | Berry et al. | 104/202 |
| 4,120,247 | 10/1978 | Muller et al. | 104/208 |
| 4,297,951 | 11/1981 | Laurent | 104/202 |
| 4,441,430 | 4/1984 | Brochand | 104/209 |

FOREIGN PATENT DOCUMENTS

| | | | |
|---|---|---|---|
| 348013 | 1/1979 | Austria . | |
| 1455007 | 2/1969 | Fed. Rep. of Germany . | |
| 768446 | 5/1934 | France | 104/202 |
| 1453517 | 9/1966 | France . | |
| 1537191 | 8/1968 | France . | |
| 676486 | 7/1979 | U.S.S.R. | 104/202 |

*Primary Examiner*—Robert B. Reeves
*Assistant Examiner*—Dennis C. Rodgers
*Attorney, Agent, or Firm*—Townsend and Townsend

[57] ABSTRACT

On the main shaft (2) of a clamping device (1), a guide-pulley (14) is provided. At the end of the main shaft, an inner clamping jaw (3) is rotatably mounted. An outer clamping jaw (7) is hinged to the inner clamping jaw (3) and connected rotation-fast to an upper frame part (6) of the clamping device. On the outer clamping jaw (7), a stop component (9) is provided. For opening the clamping jaws (3, 7), an actuating roller (10) is pressed downward, the outer clamping jaw being brought into a lower position against the pressure of a spring (21) disposed on the main shaft (2). Simultaneously the inner clamping jaw (3) rotates about the swivel joint (11) situated at the end of the main shaft (2). For closing the clamping jaws, the actuating roller (10) is moved back into its upper position. The clamping device, especially for use in cableways, requires only a few parts, which are suitable as modules both for single and for multiple couplings. The device further makes possible a simple, straight rail guidance in the coupling locations of the cableway.

10 Claims, 4 Drawing Figures

DEVICE FOR CLAMPING AND SUPPORTING A TRANSPORT APPARATUS ON A CONVEYING CABLE

The present invention relates to a device for clamping and supporting a transport apparatus on a conveying cable for use in cableways for passenger and material transportation.

Known clamping devices or automatic clamps for fastening a chair or a cabin to the conveying cable of a chair-lift or a cableway have the disadvantage that, as a rule, they comprise many parts and are not suitable as modules for single and multiple couplings. Known devices with few parts have the disadvantage that the guide rail cannot be laid in a straight line in the coupling locations.

It is therefore a task of the present invention to provide a device for clamping a transport apparatus on a conveying cable for use for chair-lifts, cableways, materialways, etc., which does not have the above-mentioned disadvantages. The device shall be distinguished by a simple construction, and standardized parts shall be able to be used for its manufacture. The clamping device shall be able to be used for various types of transport apparatus or vehicles. The device shall be suited both for use in single couplings, such as are applicable, e.g., to chairs, and in double couplings, such as are applicable, e.g., to four-passenger cabins.

Furthermore, a simple, straight rail guidance in the coupling location shall be achieved.

Furthermore, it is a task to form the device in such a way that the distance between the plane normal to the main shaft which contains the center of the guide-pulleys and the plane normal to the main shaft which contains the center of the cable is about the same before and after the coupling action. That range in which the position of the clamping jaws changes is designated the coupling action.

According to the invention, this is achieved by the characterizing features of the independent patent claim 1.

Examples of embodiments of the invention, as well as their use, are described in more detail below with the aid of the accompanying drawing.

Figure 1:
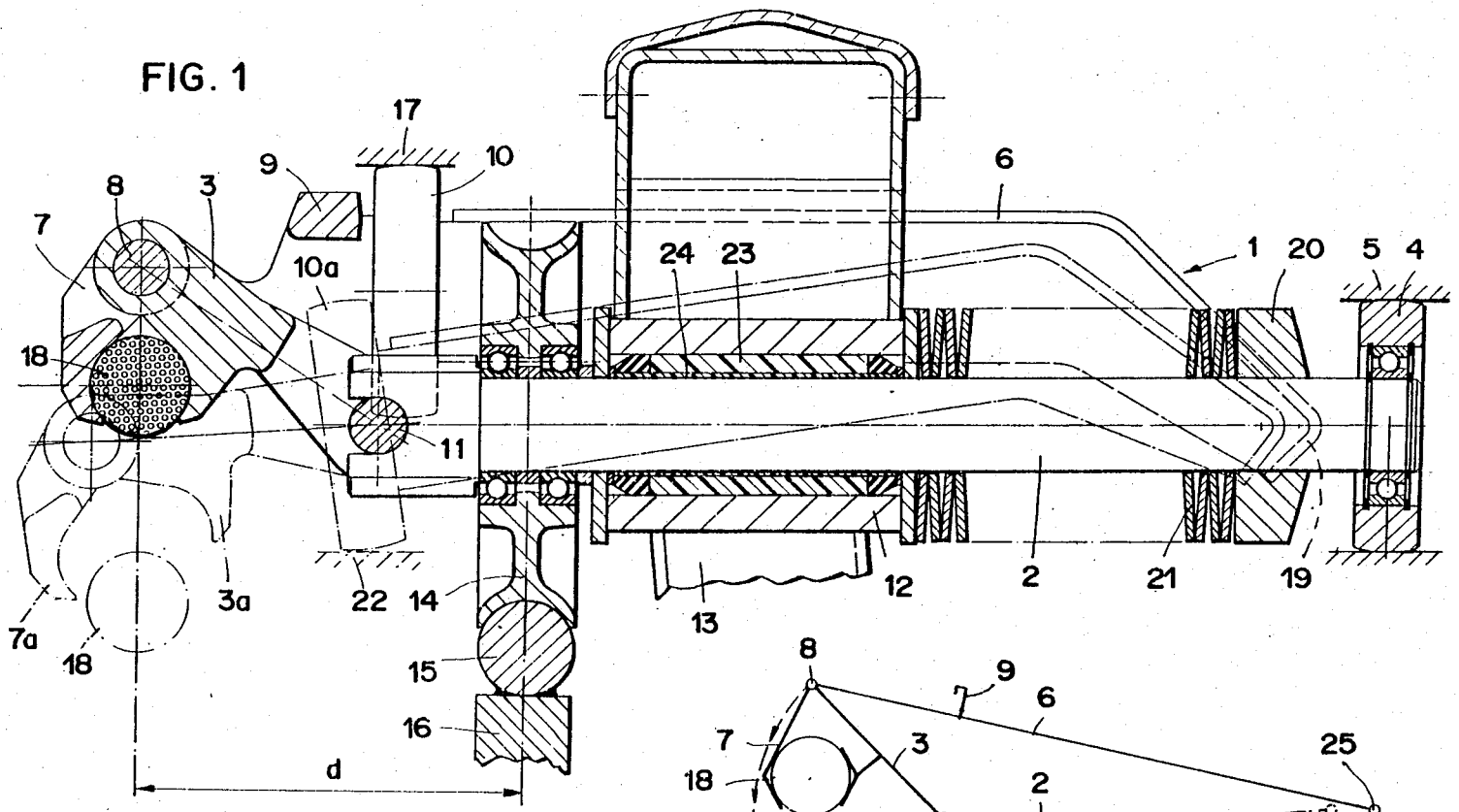
Figure 2:
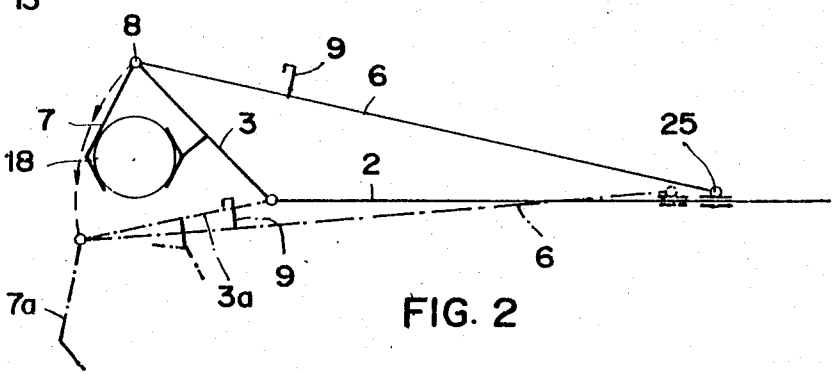
Figure 3:
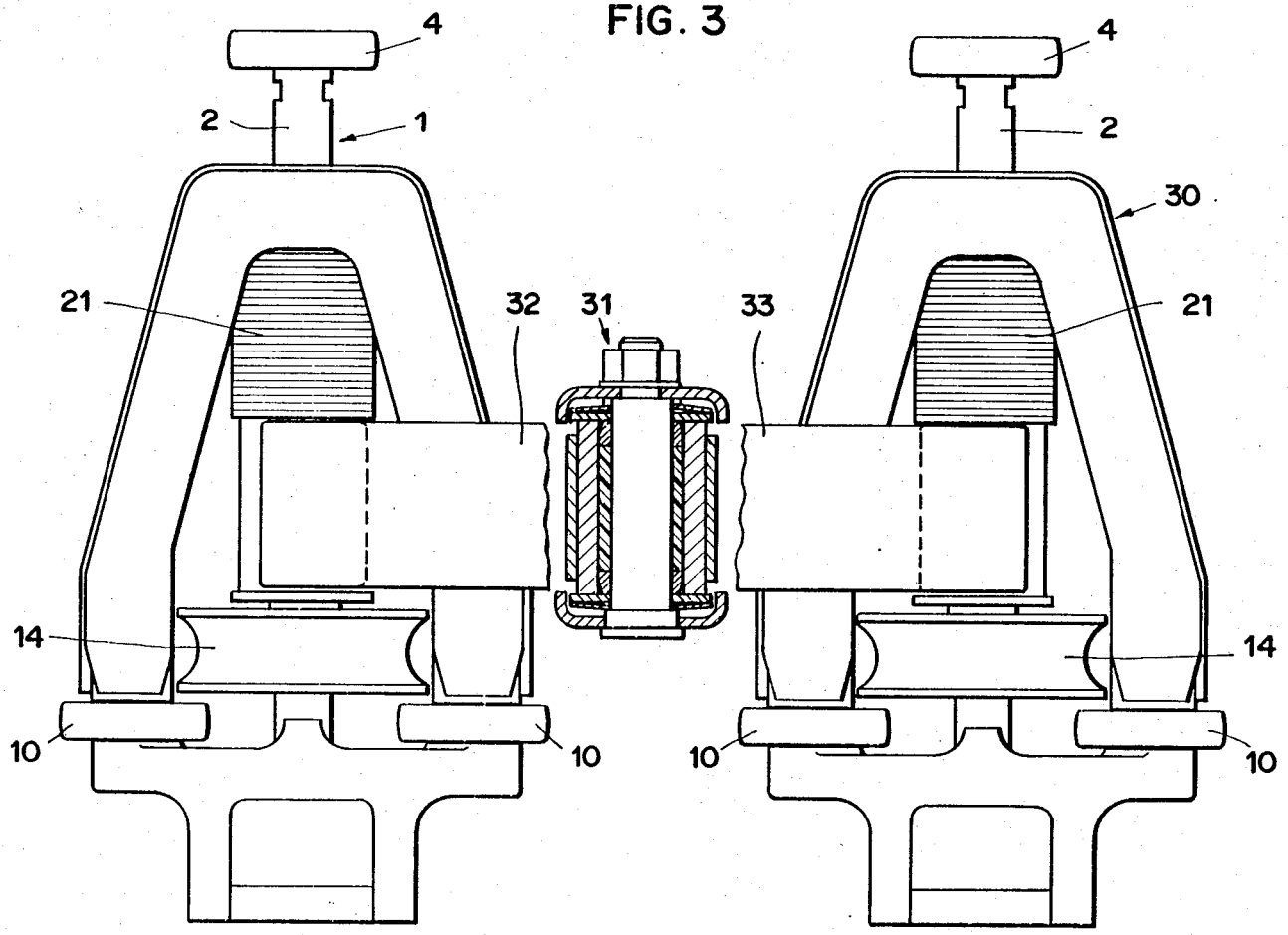
Figure 4:
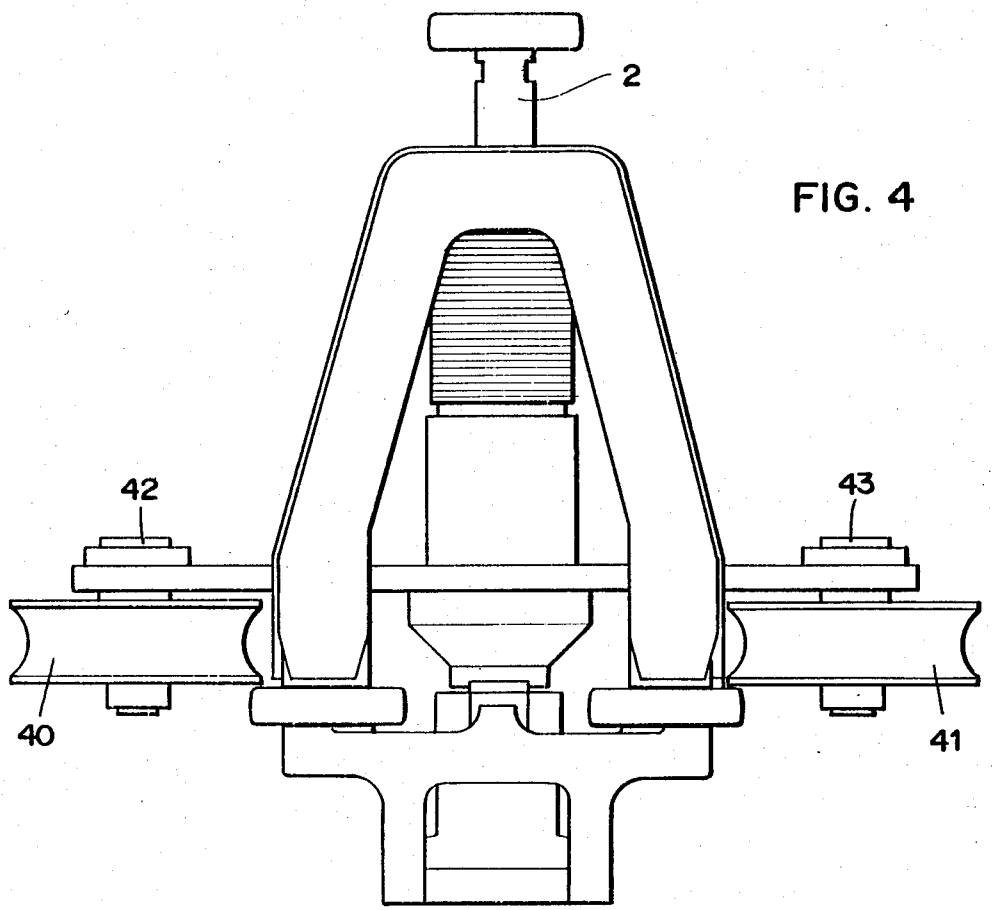

FIG. 1 shows a section through a clamping device such as is used in double couplings for suspension of cabins, FIG. 2 a schematic representation of the levers and joints of the clamping device, FIG. 3 is a top plan view, partially cut, of a double coupling, FIG. 4 a top plan view, partially cut, of a single coupling.

Represented in FIG. 1 is a cross-section through a clamping device such as is used in double couplings for cableway cabins. The clamping device 1 comprises a main shaft 2 with an inner clamping jaw 3 rotatably secured thereto. At the opposite end of the main shaft 2, a guide part 4 for guiding the clamping device with the guide rail 5 disposed in a coupling location of the cableway is provided. An upper frame part 6 of the clamping device is connected to an outer clamping jaw 7. The inner clamping jaw 3 and the outer clamping jaw 7 are rotatably connected to one another via a joint 8. An actuating roller 10 is provided on a connecting piece which connects the outer clamping jaw 7 to the upper housing part 6. On the outer clamping jaw 7, a stop component 9 is provided. On the main shaft 2, between the swivel joint 11 for the inner clamping jaw and a fastening part 12 for the suspension 13 of the cableway cabin, a guide-pulley 14 is provided for guiding the cabin with the travelling rail 15 disposed in a coupling location. The travelling rail 15 is disposed on a station rail 16.

The actuating roller 10 is moved by an opening rail 17 disposed in the mountain station and the valley station from the extended position into the dot-dashed position 10*a*, during which the clamping jaws 3 and 7 enclosing the conveying cable 18 open and assume the dot-dashed positions 3*a* and 7*a*. In the zone where the actuating roller 10 is pressed by the opening rail 17 into the lower position drawn in dot-dash lines, the conveying cable runs, not horizontally, but obliquely downward. In the position in which the two clamping jaws 3 and 7 are opening, the bearing part 20 connected to the rear part 19 of the upper frame part 6 has been displaced on the main shaft in the direction of the traction cable against the pressure of a spring 21. The rotary movement of the inner clamping jaw with respect to the outer one is limited by the stop component 9. Since, during the opening movement, the stop is not reached until the spring force against the opening movement, i.e., after passage through an unstable state, the device with opened clamping jaws in stop position is in a stable state. The distance d between the plane normal to the main shaft which contains the center of the guide-pulley 14 and the plane normal to the main shaft 2 which contains the center of the cable 18 is about the same size directly before and after the coupling action. After the loading or unloading of the vehicle, the latter is again coupled to the conveying cable, during which the actuating roller 10 is pressed by a closing rail 22 from the position 10*a* drawn in dot-dash lines into the extendedly shown position, so that the inner and outer clamping jaws 3, 7 enclose the conveying cable. The clamping mechanism comprises three levers, namely, the main shaft 2, the upper housing part 6 with the outer clamping jaw 7, as well as the inner clamping jaw 3. The levers are connected by three joints, namely, a joint between main shaft 2 and end part 19 of the upper frame part 6, a joint 8 between inner clamping jaw 3 and outer clamping jaw 7, and a joint 11 between main shaft 2 and inner clamping jaw 3.

The fastening part 12 for the suspension 13 is connected to the main shaft 2 via a damping element 23. Between damping element 23 and main shaft 2, a PVC wear-jacket 24 is provided. The element 23 exerts a damping effect upon longitudinal or transverse oscillations of the cabin.

In FIG. 2, the levers and joints of the clamping device essential to functioning are represented schematically in the two positions, the cable being clamped in the upper position. When the opening rail acts upon the clamping device, the lever formed by the upper housing part 6 and the outer clamping jaw 7 is moved about the pivot point 25 into a lower position. The inner clamping jaw 3 and the outer clamping jaw 7 rotate at that time about the swivel joint 8, the inner clamping jaw 3 being rotated relative to the main shaft 2 about the swivel joint 11.

In FIG. 3, there is represented a top plan view, partially cut, of a double coupling such as is used for larger transport apparatus. The two identical clamping devices each have two actuating rollers 10. The clamping devices 1 and 30 are connected to one another via a joint 31, connecting parts 32 and 33 connecting the clamping devices 1 and 30, respectively, to the joint 31.

In FIG. 4, there is represented a clamping device for a single clamp which is used for smaller transport apparatus, e.g., chairs. In this embodiment, the mode of operation of the individual levers and joints in the same as explained in FIGS. 1 and 2, only not one guide-pulley is provided, rather there are provided symmetrically to the main shaft 2 two guide-pulleys 40 and 41 mounted on shafts 42 and 43 which are connected to the frame of the clamping device.

I claim:

1. A device for clamping and supporting a transport apparatus on a conveying cable, having a frame, a main shaft guided in a bearing part and intended for the hanging-on of the transport apparatus, at least one guide-pulley and a clamping jaw including an inner clamping member and an outer clamping member, characterized in that the outer clamping member is connected via a frame part to the bearing part wherein said bearing part is pivotably connected to said frame part and is displaceable against the pressure of a spring, and the inner clamping member is connected jointedly to the outer clamping member and the main shaft, and a stop component is provided for limiting the clamping-jaw movement in the opening direction.

2. Device according to patent claim 1, characterized in that the spring is disposed concentrically with the main shaft between a fastening part for the transport apparatus disposed on the main shaft and the bearing part.

3. A device according to claim 1 or 2 further comprising, an actuating roller provided between the clamping jaws and the frame part for opening or closing the clamping jaws.

4. A device as in claim 1 further comprising means for limiting the pivoting of the frame.

5. A device as in claim 4 wherein the limiting means includes means for limiting the pivoting of the frame symmetrically across the axis of the shaft.

6. A device for clamping and supporting a transport apparatus on a conveying cable comprising:

a frame having opposite ends;

a main shaft for supporting a transport apparatus;

a bearing part pivotably connected to one end of the frame and slidingly connected to the main shaft;

means for biasing the bearing part in a prescribed direction along the shaft;

a clamping jaw including:

an outer clamping member connected to the other end of the frame;

an inner clamping member pivotally connected to the outer clamping member and to the main shaft.

7. A device as in claim 6 further comprising a coupler connected to the shaft for supporting a transport apparatus, and wherein the biasing means comprises a spring disposed between the coupler and the bearing part.

8. A device as in claim 6 further comprising means for opening and closing the clamping jaws.

9. A device as in claim 8 wherein the opening and closing means comprises means for pivoting the inner clamping member relative to the main shaft and to the outer clamping member for selectively opening and closing the clamping jaw.

10. A device for clamping and supporting a transport apparatus on a conveying cable comprising:

a main shaft;

a coupler connected to the main shaft for supporting a transport apparatus;

a frame having opposite ends;

a bearing part pivotably connected to one end of the frame and slidingly connected to the main shaft;

a spring disposed between the bearing part and the coupler for biasing the bearing part away from the coupler;

a clamping jaw including:

an outer clamping member connected to the other end of the frame;

an inner clamping member pivotally connected to the outer clamping member and to the main shaft;

means for pivoting the inner clamping member relative to the main shaft and to the outer clamping member for selectively opening and closing the clamping jaw;

means for limiting the pivoting of the frame symmetrically across the axis of the shaft.

* * * * *